US006964088B2

(12) United States Patent
Crevoisier

(10) Patent No.: US 6,964,088 B2
(45) Date of Patent: Nov. 15, 2005

(54) COMBINED TOOLS FOR COUNTERSINKING AND INSERTING PINS

(75) Inventor: Nicolas Crevoisier, Lajoux (CH)

(73) Assignee: Metafil Lagirolle SA, Lajoux (CH)

( * ) Notice: Subject to any disclaimer, the term of this patent is extended or adjusted under 35 U.S.C. 154(b) by 123 days.

(21) Appl. No.: 10/433,334

(22) PCT Filed: Dec. 14, 2001

(86) PCT No.: PCT/CH01/00716

§ 371 (c)(1),
(2), (4) Date: Sep. 11, 2003

(87) PCT Pub. No.: WO02/49476

PCT Pub. Date: Jun. 27, 2002

(65) Prior Publication Data

US 2004/0034978 A1 Feb. 26, 2004

(30) Foreign Application Priority Data

Dec. 19, 2000 (CH) ..... 2464/00

(51) Int. Cl.[7] ..... B23P 19/04

(52) U.S. Cl. ..... 29/268

(58) Field of Search ..... 29/267, 268, 257

(56) References Cited

U.S. PATENT DOCUMENTS

| | | | | |
|---|---|---|---|---|
| 777,006 | A * | 12/1904 | Conrad | 29/268 |
| 3,698,181 | A | 10/1972 | Paul et al. | |
| 4,157,594 | A | 6/1979 | Raabe | |
| 5,148,590 | A | 9/1992 | Wu | |
| 5,208,929 | A | 5/1993 | Chou | |

FOREIGN PATENT DOCUMENTS

| | | |
|---|---|---|
| CH | 432095 | 9/1967 |
| CH | 689993 | 3/2000 |
| DE | 2 742 635 | 4/1979 |
| DE | 4 125 506 | 4/1993 |
| EP | 0 636 459 | 2/1995 |
| GB | 2 084 502 | 4/1982 |
| JP | 1 257 574 | 10/1989 |
| JP | 2 279 281 | 11/1990 |

* cited by examiner

*Primary Examiner*—Robert C. Watson
(74) *Attorney, Agent, or Firm*—Pearne & Gordon LLP

(57) ABSTRACT

The invention concerns a combined tool for countersinking or inserting pins is essentially shaped like a pliers, comprising a handle and a lever articulated about a pin, the ends of the handles, respectively of the lever, opposite to the ends forming hand grips, bearing a body for receiving the object portion provided with the pin to be countersunk or inserted and an end portion adapted to actuate a pin-punch or a pin-pusher located in a housing of said body. The combined tool is particularly designed to countersink or insert a pin connecting two successive links of a bracelet.

10 Claims, 2 Drawing Sheets

Fig 1b
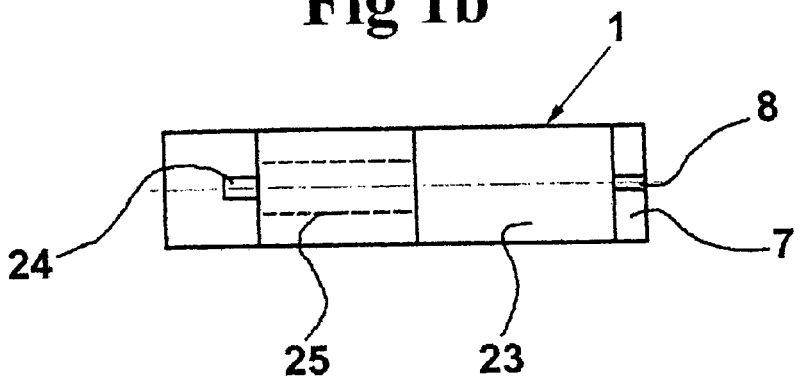
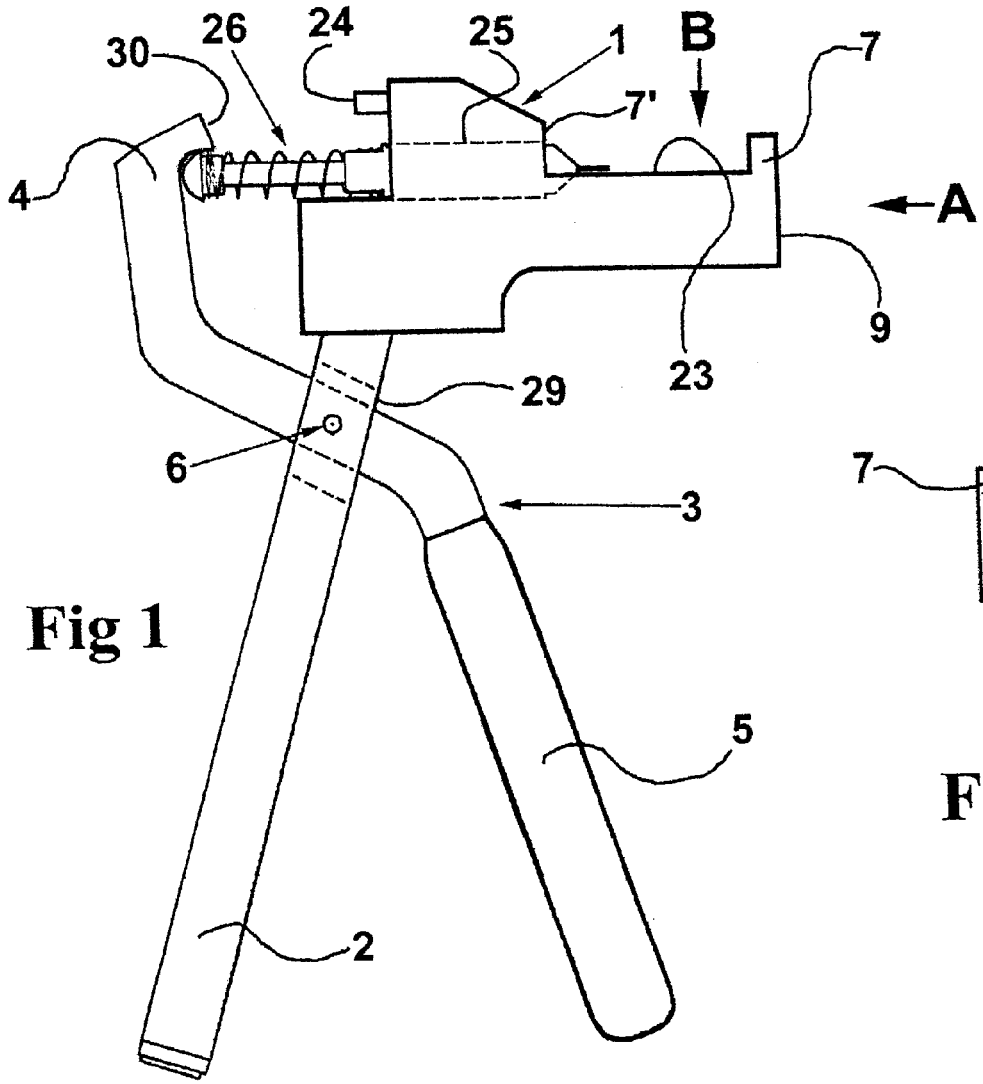
Fig 1
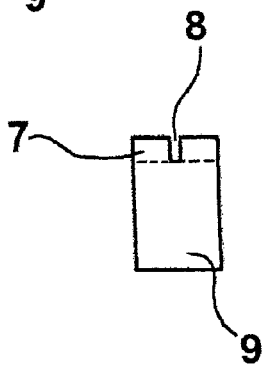
Fig 1a

COMBINED TOOLS FOR COUNTERSINKING AND INSERTING PINS

BACKGROUND OF THE INVENTION

The present invention is concerned with a combined tool for retrieving and for inserting pins, in particular, pins connecting together articulated objects, more particularly the links of a bracelet and, especially the links of a bracelet of a wristwatch.

PRIOR ART

At the present time, bracelets are available which are comprised of a plurality of links, made of a metal or of a plastic material, hingedly held together by pins, in particular bracelets for wristwatches. A problem then arises, when the length of a bracelet of this type needs to be adapted. In fact, in order to shorten or lengthen such a bracelet, one must remove, respectively, add, one or more links, which requires the retrieval or the insertion of at least one pin. The pin retrieval or addition operation is an operation which is delicate, which requires special tools and during which the bracelet must be secured against motion.

The device described in DE 41 25 506 endeavours to provide a solution to this problem. This solution is not satisfactory, because, to retrieve a pin, it is necessary to rotate a pusher, while maintaining the bracelet in a defined position. Furthermore, the device is suitable for only one pin diameter and, accordingly, a specific device must be made available for each pin diameter.

Patent CH 689 993 describes a device for adjusting and for repairing bracelets. This device is relatively complete in that it makes it possible to carry out various operations on a bracelet formed from links, but its utilisation is difficult, and both the retrieval and the insertion of a pin are time consuming. Furthermore, this device necessitates the positioning of a bracelet between two shoulders, the pin being subsequently pushed by a screw means, which is operated manually.

SUMMARY OF THE INVENTION

The first objective of the invention is to provide a tool, which is improved by comparison with known tools and devices.

Another objective of the invention is to provide a tool, which is simple, inexpensive to manufacture, easy to handle and which makes it possible to adjust rapidly to the desired length, a bracelet made from links.

Yet another objective of the invention is to provide a tool which is simple and which makes it possible to rapidly to insert a pin or to remove a pin holding together two successive links of a bracelet, without having to rotate any key, screw, bolt or button.

The invention will be better understood and its advantages and characteristic features will become more clearly apparent from the description below of an exemplary embodiment of a combined tool for retrieving and for inserting pins according to the invention.

BRIEF DESCRIPTION OF THE DRAWINGS

FIG. 1 represents, schematically, a tool according to the invention, in a preferred embodiment thereof;

FIGS. 1*a* and 1*b* represent, respectively, a front view along arrow A and a plan view along arrow B of the tool represented in FIG. 1.

DESCRIPTION OF THE PREFERRED EMBODIMENT

Figure 2:
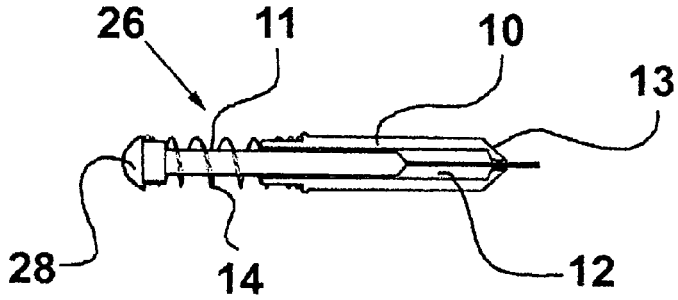
FIG. 2 is a schematic cross-sectional view of a component part designed for retrieving pins, for use with the tool represented in FIG. 1.

As represented in FIGS. 1, 1*a* and 1*b*, a combined tool for retrieving and for inserting pins, for example those holding together two successive links of a bracelet, includes, in the embodiment illustrated, a body 1 having a shape fitting substantially inside a parallelepiped and exhibiting an angular U-shaped housing limited by the faces 7', 23 and 7 and designed for receiving two successive links of a bracelet, which are either to be disassembled, or to be assembled together by means of a pin. The body 1 is contiguous to a handle 2 providing a first hand grip and it is affixed thereto, in the embodiment illustrated, via the side at the opposite of the side with the U-shaped housing.

The handle 2, which has a circular cross-section in the present embodiment, exhibits, at a location close to the body 1, a slot 29 designed for receiving a lever 3 having the shape of an elongated S and providing a second hand grip 5 which has a rectangular cross-section and which is pivotally connected to the handle 2, via an axis or a pin 6, the handle 2 and the lever 3 forming the two hand grips 2 and 5 of a pair of pliers. Clearly, other forms than those described above can be envisaged for the two hand grips, for instance by inverting the circular cross-section and the rectangular cross-section or by designing both hand grips with a rectangular cross-section.

The lever 3 has, at its end portion 4 which is at the opposite of the hand grip 5, a portion 30 capable of pressing, when the pliers are actuated, against an end of a member 26 or 27, of which the constructional details, the operations and the usefulness will be explained subsequently, with reference to FIGS. 2 and 3.

The body 1 further includes a hollow passage or a cylindrical housing 25, of which the axis runs parallel both to the actuation plane of the two hand grips 2 and 5 of the pliers and to the plane of the face 23 of the U-shaped housing. This housing 25 is intended for receiving a pin-punch 26 as illustrated in FIG. 2 or a pin-pusher 27 as illustrated in FIG. 3.

As it is apparent from FIG. 1*a*, the body 1 has a front face 9, which is rectangular in the embodiment illustrated and which has a groove 8 at its upper part, extending through the side 7 of the U-shaped housing. The groove 8 is aligned with the axis of the above-mentioned housing 25.

Furthermore, the body 1, as illustrated here, carries on its face which is at the opposite of the face 9, an abutment component part 24 running parallel to the axis of the housing 25 and designed for co-operating with said portion 30 for catching hold of a pin partly expelled from its housing.

FIG. 2 is a schematic cross-sectional view of a pin-punch 26 designed for the combined tool described above. This pin-punch has a hollow cylinder 10, of which the outer diameter is very slightly smaller than that of the housing 25, so that it may be introduced therein. An end 13 of the cylinder 10 is, preferably, of a conical shape so that it may be placed as close as possible to the pin which is to be expelled, so as to limit the risk of buckling of the needle 12. The cylinder 10 has an axial bore which extends over its whole length and in which is guided slidably a rod 11 carrying the needle 12 at its end. A spring 14, placed between the end of the cylinder 10 which is at the opposite of the end 13 and a head 28 of the rod 11, situated at the end which is at the opposite of the end carrying the needle 12, holds the rod 11, respectively the tip of the needle 12, retracted with respect to the tip of the conical end 13 of the pin-punch 26.

A plurality of pin-punches 26 such as those described above are made available, each one having a needle 12 of a given diameter for retrieving a pin of a determined diameter.

Figure 3:
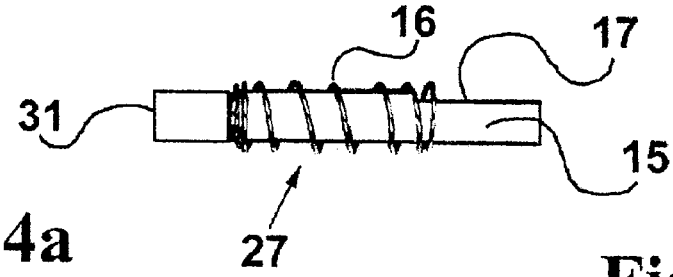
FIG. 3 represents, schematically, a component part designed for inserting pins, for use with the tool represented in FIG. 1, and FIGS. 4*a, b, c* and *d* represent securing devices for the tool represented in FIG. 1.

FIG. 3 illustrates schematically a pin-pusher 27 designed for the combined tool described above. This pin-pusher has a cylindrical body 15, of which the diameter is very slightly smaller than that of the housing 25, one end of said cylindrical body has a head 31 providing an abutment for a spring 16, and the other end has a flat surface designed for pushing the pin, when the same is inserted.

Figure 4A:
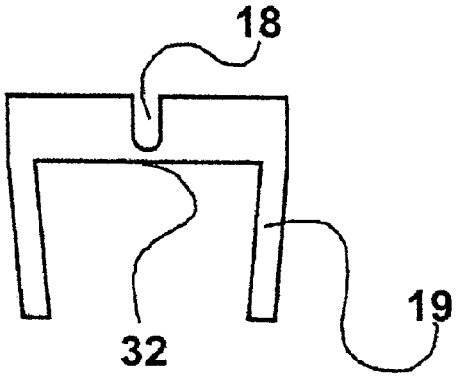
Figure 4B:
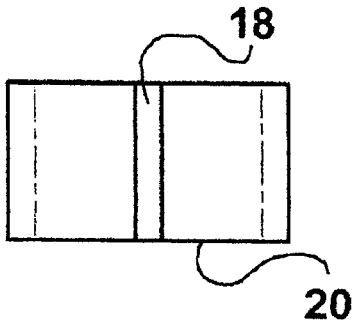

FIGS. 4*a* and 4*b* are two views illustrating a securing device 20 designed for use with parallel links and for being placed in the U-shaped housing in order to adapt the shape and the dimensions of the latter to the shape and to the dimensions of the bracelet. As is apparent from FIG. 4*a*, the securing device 20 has the shape of an inverted U, of which the upper face of the upper portion 32 is provided with a groove 18 and the two legs 19 of the U slope slightly inwardly, to retain the securing device 20 on the body 1.

Figure 4C:
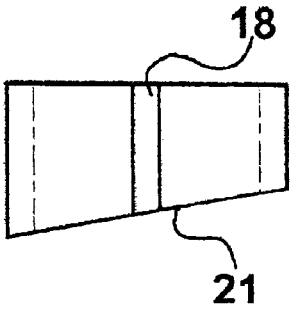
Figure 4D:
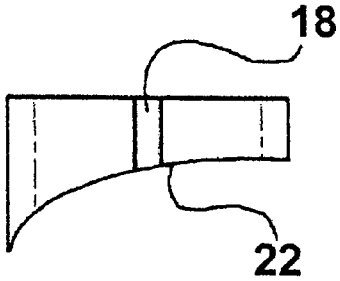

FIGS. 4*c* and 4*d* show securing devices 21 and 22 designed respectively for links having a trapezoidal shape and for links having a curved portion.

Other alternate versions of the securing devices can be envisaged, depending on the shape of the links processed. Preferably, a plurality of securing devices of differing thickness will be available for links of differing dimensions.

Preferably, the body 1 will be made of a material, which is relatively soft, for example of a plastic material, to avoid the scratching of the objects placed thereupon, in particular the links of a bracelet.

To retrieve a pin holding together two links of a bracelet, one must first select the pin-punch 26 carrying the needle 12 having a diameter adapted to that of the pin to be retrieved and the pin-punch 26 is introduced into the housing 25, in such a manner that its conical end 13 protrudes into the U-shaped housing of the body 1. The effect of the spring 14 is to push away from each other the two hand grips 2 and 5, with the needle being, at that time, entirely retracted with respect to the tip of the conical end 13. Then, the securing device 20, 21 or 22, which is adapted to the shape and to the dimensions of the links, is placed in the U-shaped housing of the body 1 and, subsequently, the portion of the bracelet with the pin to be expelled is placed into said housing, in such a manner that the needle 12, the pin to be expelled, the groove 18 of the securing device and the groove 8 of the body 1 be aligned. By subsequently bringing together the two hand grips 2 and 5 of the pliers, the needle 12 is pushed outside of the cylinder 10 by the rod 11 and it expels the pin facing it from its housing, said pin being subsequently guided along the aligned groves 18 and 8. When the hand grips come apart, the needle 12 retracts inside the cylinder 10 owing to the action of the spring 14. It then becomes possible to remove the bracelet with its two links still held together by the pin, which is partly removed. The removal can be completed either by gripping the pin with two fingers, or by holding the same between the head 30 and the abutment component part 24 and by pressing together the two hand grips 2 and 5 of the pliers.

To introduce a pin for fastening together two successive links of a bracelet, a pin-pusher 27 is placed first in the housing 25, while the two hand grips 2 and 5 are kept apart owing to the action of the spring 16. Thereafter, the portion of the bracelet including the two links, which are to be joined together by a pin, is positioned and the introduction of the pin into the housing between the two links is started, while however leaving the pin protruding in the direction of the pin-pusher 27. Then, the two hand grips 2 and 5 of the pliers are brought together, with the result that the end of the pin-pusher 27 is urged against the protruding end of the pin, thus pushing the same into its housing between the two links of the bracelet.

The combined tool was described hereabove in a preferred embodiment, but clearly other embodiments or alternate versions can be envisaged. Also, the combined tool as it is described can be used for retrieving or extracting a pin connecting two successive parts of any object. This object can be a bracelet comprised of links held together by pins, and it can be, in particular, a bracelet of a wristwatch. Many other uses can be envisaged for such a combined tool, for example for the mounting and the dismounting of roller chains.

What is claimed is:

1. A combined tool for retrieving and for inserting pins, including a body exhibiting a housing which has the shape of a U and which is designed for receiving a portion of the object from which a pin is to be retrieved or into which a pin is to be inserted, said combined tool including additionally a handle and a lever pivotally connected via an axis to thus form pliers including a first hand grip and a second hand grip, said body being fixed to the part of the handle extending from said first hand grip, said body comprising a cylindrical housing having a longitudinal axis in a plane running parallel to the plane of actuation of said hand grips of the pliers and in a plane running parallel to a face of the bottom of said U-shaped housing, said cylindrical housing being capable of receiving removable portions of said tool, said removable portions of said tool being a component part for retrieving a pin and a component part for inserting a pin, and each of said removable portions of said tool, when placed in said housing being actuated by a part of the lever extending from said second hand grip.

2. A combined tool according to claim 1, characterised in that the body fixed to the part of the handle extending from the first hand grip comprises an abutment part, whereas the part of the lever extending from the second hand grip includes an end portion, said abutment part and said end portion being capable of moving towards each other when said hand grips are drawn together, thus enabling the gripping of an object and, in particular, of a pin.

3. A combined tool according to claim 1, characterised in that the component, part for retrieving a pin, includes a cylinder comprising a longitudinal bore, a rod which carries a needle extending therefrom and which is capable of sliding in said bore, a spring means provided for withdrawing the rod, respectively the needle, inside said longitudinal bore, said spring means being further capable—when said component part for retrieving a pin is installed in the cylindrical housing of the body—of urging the two hand grips into their spaced apart position.

4. A combined tool according to claim 3, characterised in that the end of the component part for retrieving a pin, which end protrudes into the U-shaped housing of the body, has a conical shape.

5. A combined tool according to claim 1, characterised in that said combined tool includes several removable portions of the tool being component parts for retrieving a pin, each one of said removable portions of the tool being provided with a needle of a diameter adapted to that of the pin to be retrieved.

6. A combined tool according to claim 1, characterised in that the removable portion of the tool being a component part for inserting a pin includes a cylinder and a spring means abutting against a head provided at one end of said cylinder, the spring means being capable—when said component part for inserting a pin is installed in the cylindrical housing of the body—of keeping the two hand grips in a spaced apart position.

7. A combined tool according to characterised in that said combined tool further includes a plurality of securing devices of various shapes and dimensions, designed for being placed in the U-shaped housing to adapt the shape and the dimensions of the object from which a pin is to be retrieved or into which a pin is to be inserted, to those of the U-shaped housing.

8. A combined tool according to claim 7, characterised in that the upper face of the portion of the body forming a leg of the U-shaped housing which is at the opposite of the leg provided with the cylindrical housing, as well as the upper face of a central portion of the securing devices have a groove aligned with the needle.

9. Use of a combined tool according to claim 1 for inserting or for retrieving a pin holding together two successive component parts of an object, respectively two successive links of a bracelet and, in particular, of a bracelet of a wristwatch.

10. A combined tool according to claim 1, characterised in that the body is made of a material of a hardness, which is lesser than that of the constituent material of said object.

* * * * *